US012490786B2

(12) United States Patent
Dierkes et al.

(10) Patent No.: US 12,490,786 B2
(45) Date of Patent: Dec. 9, 2025

(54) CHEST PROTECTOR

(71) Applicant: Wilson Sporting Goods Co., Chicago, IL (US)

(72) Inventors: Matthew J. Dierkes, Chicago, IL (US); Krista A. Lenss, Chicago, IL (US); Shaun P. Gilday, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 65 days.

(21) Appl. No.: 17/506,920

(22) Filed: Oct. 21, 2021

(65) Prior Publication Data

US 2022/0142266 A1 May 12, 2022

Related U.S. Application Data

(60) Provisional application No. 63/112,415, filed on Nov. 11, 2020.

(51) Int. Cl.

| | |
|---|---|
| ***A41D 13/05*** | (2006.01) |
| ***A41D 13/015*** | (2006.01) |
| ***A41D 13/04*** | (2006.01) |
| *A63B 71/12* | (2006.01) |

(52) U.S. Cl.

CPC ..... *A41D 13/0518* (2013.01); *A41D 13/015* (2013.01); *A41D 13/043* (2013.01); *A41D 13/0506* (2013.01); *A41D 13/0537* (2013.01); *A63B 2071/1208* (2013.01)

(58) Field of Classification Search

CPC ..... A41D 13/0518; A41D 13/0537; A41D 13/0506; A41D 13/05; A41D 13/043; A41D 13/04; A41D 13/015; A63B 2071/1208; A41B 13/10

See application file for complete search history.

(56) References Cited

U.S. PATENT DOCUMENTS

| | | | | |
|---|---|---|---|---|
| 1,592,283 | A * | 7/1926 | McKenzie | A61B 46/00 2/48 |
| 3,771,171 | A | 11/1973 | Mitchell | |
| 3,945,041 | A * | 3/1976 | Rhee | A63B 71/12 2/463 |
| 5,048,126 | A | 9/1991 | McLaughlin | |
| 5,373,582 | A * | 12/1994 | Dragone | F41H 1/02 2/2.5 |
| 5,500,951 | A | 3/1996 | Marchello | |
| 5,530,966 | A | 7/1996 | West | |
| 5,581,805 | A | 12/1996 | Rennick | |
| 5,617,580 | A | 4/1997 | DiCesare et al. | |
| 5,675,844 | A | 10/1997 | Guyton et al. | |
| 5,680,657 | A | 10/1997 | Valtakari | |
| 5,689,836 | A | 11/1997 | Fee et al. | |
| 5,794,261 | A | 8/1998 | Hefling | |
| 6,195,809 | B1 | 3/2001 | Garcia | |
| 6,460,197 | B2 | 10/2002 | Huang | |
| 6,507,955 | B1 | 1/2003 | Fee et al. | |

(Continued)

*Primary Examiner* — Khoa D Huynh
*Assistant Examiner* — Giao QT Hoang
(74) *Attorney, Agent, or Firm* — Terence P. O'Brien; Todd A. Rathe

(57) ABSTRACT

A chest protector may include shoulder portions to extend over shoulders of a sport participant wearing the chest protector, a padded chest portion to extend over the chest of a sport participant wearing the chest protector, a padded torso portion and a pliable shaper extending across the padded torso portion.

15 Claims, 8 Drawing Sheets

(56) References Cited

U.S. PATENT DOCUMENTS

| | | | |
|---|---|---|---|
| 6,519,781 | B1 | 2/2003 | Berns |
| 6,743,325 | B1 | 6/2004 | Taylor |
| 6,772,439 | B1 | 8/2004 | McMullen, Jr. |
| 6,810,534 | B2 | 11/2004 | Durkin et al. |
| 6,880,172 | B2 | 4/2005 | Quintero |
| 7,013,487 | B2 | 3/2006 | Beland |
| 7,100,216 | B2 | 9/2006 | Matechen et al. |
| 7,353,546 | B2 | 4/2008 | Hunt |
| 7,487,556 | B2 | 2/2009 | Morrow et al. |
| 7,503,080 | B2 | 3/2009 | Link |
| D590,999 | S | 4/2009 | Kanavage |
| D591,000 | S | 4/2009 | Kanavage |
| 7,523,508 | B2 | 4/2009 | Contant et al. |
| 7,581,258 | B2 | 9/2009 | Baron et al. |
| 7,669,250 | B2 | 3/2010 | Baron et al. |
| RE41,346 | E | 5/2010 | Taylor |
| 7,712,150 | B2 | 5/2010 | Pardillo et al. |
| 7,730,549 | B2 | 6/2010 | Morrow et al. |
| 7,748,056 | B2 | 7/2010 | Mickle |
| 7,754,626 | B2 | 7/2010 | Baron et al. |
| 7,770,233 | B2 | 8/2010 | Haskell |
| 7,784,116 | B2 | 8/2010 | Gallo et al. |
| 7,891,026 | B1 | 2/2011 | Smith |
| 7,895,681 | B2 | 3/2011 | Ferrara |
| 7,992,226 | B2 | 8/2011 | Turner |
| 7,993,277 | B1 | 8/2011 | Link |
| 8,015,621 | B2 | 9/2011 | Udelhofen |
| 8,021,994 | B2 | 9/2011 | Zumloh |
| 8,082,602 | B2 | 12/2011 | Crelinsten et al. |
| 8,095,996 | B2 | 1/2012 | Turner |
| 8,161,569 | B2 | 4/2012 | Hudon et al. |
| 8,256,034 | B2 | 9/2012 | Berner, Jr. et al. |
| 8,261,369 | B2 | 9/2012 | Sioui et al. |
| 8,266,727 | B2 | 9/2012 | Lee |
| 8,272,073 | B2 | 9/2012 | Arensdorf et al. |
| 8,281,414 | B2 | 10/2012 | Mickle |
| 8,296,862 | B2 | 10/2012 | Sandusky et al. |
| 8,296,864 | B2 | 10/2012 | Torry |
| 8,298,648 | B2 | 10/2012 | Turner et al. |
| 8,327,462 | B2 | 12/2012 | Feldman et al. |
| 8,327,463 | B2 | 12/2012 | Udelhofen |
| 8,336,124 | B2 | 12/2012 | Crelinsten et al. |
| 8,353,062 | B2 | 1/2013 | Landi et al. |
| 8,353,067 | B2 | 1/2013 | Chen et al. |
| 8,425,712 | B2 | 4/2013 | Turner |
| 8,438,667 | B2 | 5/2013 | Grogro et al. |
| 8,438,669 | B2 | 5/2013 | Turner |
| 8,484,766 | B2 | 7/2013 | Smith |
| 8,548,622 | B2 | 10/2013 | Berns et al. |
| 8,597,222 | B2 | 12/2013 | Lucero et al. |
| 8,863,320 | B2 | 10/2014 | Kelly et al. |
| 9,468,242 | B1 * | 10/2016 | Lee ..... A41D 13/04 |
| 2002/0007509 | A1 | 1/2002 | Kamada |
| 2004/0111789 | A1 | 6/2004 | Niki |
| 2004/0154083 | A1 | 8/2004 | McVicker |
| 2005/0208859 | A1 | 9/2005 | Baron et al. |
| 2008/0083055 | A1 | 4/2008 | Onda |
| 2008/0209616 | A1 | 9/2008 | Manning et al. |
| 2010/0024089 | A1 | 2/2010 | Turner |
| 2010/0024100 | A1 | 2/2010 | Sokolowski et al. |
| 2010/0125925 | A1 | 5/2010 | Hanlon |
| 2010/0192270 | A1 | 8/2010 | Schlichtig |
| 2010/0272969 | A1 | 10/2010 | Taylor |
| 2010/0285299 | A1 | 11/2010 | Taylor |
| 2010/0287690 | A1 | 11/2010 | Kanavage |
| 2010/0293703 | A1 | 11/2010 | Tezartes-Strauss et al. |
| 2011/0061154 | A1 | 3/2011 | Turner et al. |
| 2011/0185483 | A1 | 8/2011 | Lewis |
| 2011/0209275 | A1 | 9/2011 | Berns et al. |
| 2011/0252549 | A1 | 10/2011 | Jourde et al. |
| 2011/0307998 | A1 | 12/2011 | Turner |
| 2012/0052249 | A1 | 3/2012 | Turner |
| 2012/0084896 | A1 | 4/2012 | Wyner et al. |
| 2012/0167290 | A1 * | 7/2012 | Kovacevich ..... F16G 11/14 2/463 |
| 2012/0180181 | A1 | 7/2012 | Best et al. |
| 2016/0202023 | A1 * | 7/2016 | Osman ..... A41F 15/002 2/2.5 |
| 2016/0235144 | A1 * | 8/2016 | Saberzadeh ..... A41D 27/08 |

* cited by examiner

CHEST PROTECTOR

CROSS REFERENCE TO RELATED APPLICATIONS

The present application is a non-provisional patent application claiming priority from U.S. Provisional Patent Application Ser. No. 63/112,415 filed on Nov. 11, 2020 entitled CHEST PROTECTOR, the full disclosure which is hereby incorporated by reference.

BACKGROUND

Chest protectors protect the upper body and torso of a sport participant wearing the chest protector while providing the sport participant with some freedom of movement. Such chest protectors include padded portions that protect against impact. Chest protectors may be utilized in a variety of different activities and sports. For example, baseball and softball catchers may wear such a chest protector. Baseball and softball umpires may wear chest protectors. Hockey and lacrosse goalies may wear chest protectors. Participants playing paintball sports or other similar activities may wear chest protectors.

Figure 1:
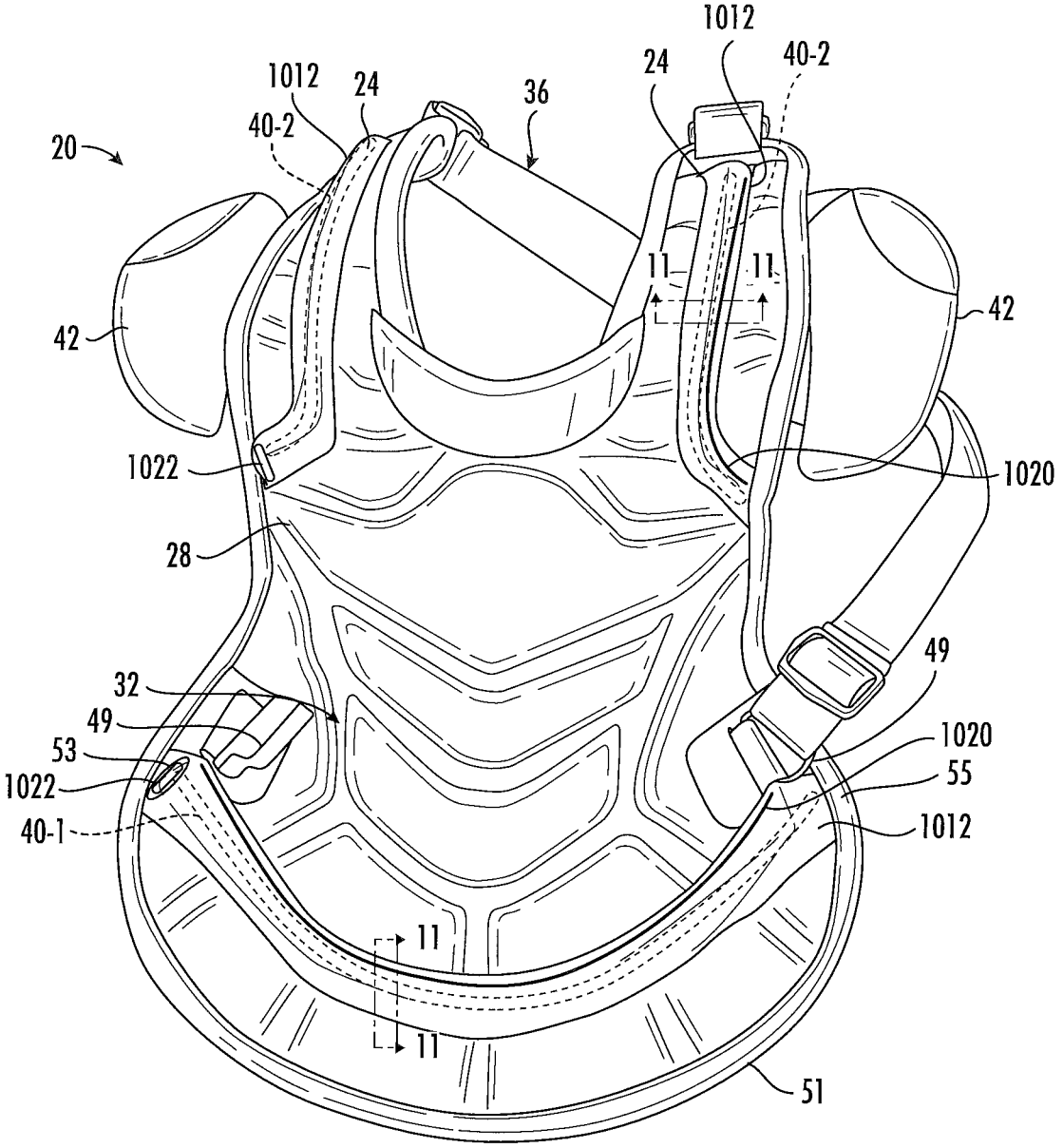
FIG. 1 is a front perspective view of an example chest protector.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example chest protectors that are conformable to the body of a sport participant wearing the chest protector. The example chest protectors utilize a pliable shaper to retain a selected shape for portions of the chest protector.

A "pliable shaper" refers to a structure that is manually bendable to a selected shape or profile, wherein the pliable shaper retains the selected shape or profile once established until the pliable shaper is once again intentionally manually bent to a different shape or profile. The pliable shaper is sufficiently pliable so as to be manually bendable or shapeable by sport participant without tools or equipment such that the pliable shaper may be bent to a desired shape while the chest protector is worn, permitting the sport participant to more accurately match the selected shape of the chest protector to his or her body shape. Once in the desired shape, the pliable shaper is sufficiently stiff so as to retain its selected shape once established despite the typical forces that may be exerted upon the pliable shaper during movement of the sport participant wearing the chest protector during a sport or activity.

The example chest protectors having the pliable shaper may be shaped to conform to the body shape of the sport participant wearing the chest protector. For example, the pliable shaper may be bent to a shape that matches the shape of the sport participant wearing the chest protector. As a result, the chest protector may better conform to the shape of the sport participant wearing the chest protector. The enhanced body-fitting shape may facilitate greater freedom of movement are better performance by the sport participant wearing the chest protector. The enhanced body fitting shape may more actively locate and retain padding of the chest protector to better protect the sport participant wearing the chest protector.

Moreover, because the example pliable shapers may be repeatedly reshaped, without damage to the pliable shapers, the example chest protectors may also be repeatedly reshaped. As a result, a single chest protector may be easily reshaped to conform to the different body shapes of different sport participants wearing the chest protectors. The single chest protector may adapt to differently sized sport participants. The example chest protector may serve as a one chest protector fits all solution for reducing equipment costs and for ensuring that the chest protector being worn by sport participants are properly sized and fitted to the sport participant's anatomy to best protect the upper body and torso of the sport participant.

In some implementations, the pliable shaper may be formed of a material that is bendable at room temperature without any stimulus being applied to the material and retains its selected shape at room temperature despite movement of the sport participant wearing the chest protector during a sport activity. For example, in some implementations, the pliable shaper may be a metal band or wire (such as an armature wire) that is bendable to a selected shape at room temperature and retains the selected shape despite movement of the sport participant wearing the chest protector during a sport activity or other activity. In some implementations, the pliable shaper may be formed from other materials which are pliable or bendable at room temperature and which retain their selected shape despite movement of the sport participant wearing the chest protector during sport activity or other activity.

In some implementations, the pliable shaper may be shapeable upon the application of a stimulus, such as heat, to the pliable shaper, wherein withdrawal of the stimulus results in the pliable shaper retaining its shape until the stimulus is reapplied.

In some implementations, the example chest protectors incorporate the pliable shaper across the torso region of the chest protector. As a result, the chest protectors may be shaped to conform to the sport participants torso for a slim fitting appearance and for enhanced freedom of motion. In some implementations, the example chest protectors additionally or alternatively incorporate the pliable shaper in shoulder regions of the chest protector. As a result, the chest protectors may be shaped to conform to the shoulders of the sport participant for enhanced freedom of motion. In some circumstances, a sport participant may wish that portions of the chest protector not conformally contact the body of the sport participant, but that such portions be spaced from the body of the sport participant. In such circumstances, the sport participant may shape the pliable shaper so as to provide such additional gaps or spacing between the chest protector and the underlying body of the sport participant.

Disclosed is an example chest protector. The example chest protector may include shoulder portions to extend over shoulders of a sport participant wearing the chest protector, a padded chest portion to extend over the chest of a sport participant wearing the chest protector, a padded torso portion and a pliable shaper extending across the padded torso portion.

Disclosed is an example chest protector. The example chest protector may include shoulder portions to extend over shoulders of a sport participant wearing the chest protector, a padded chest portion to extend over the chest of a sport participant wearing the chest protector and a padded torso portion. The padded torso portion may comprise a first padded region, a second padded region, a channel extending between the first padded region and the second padded region and a pliable shaper extending within the channel across a majority of the padded torso portion.

Figure 2:
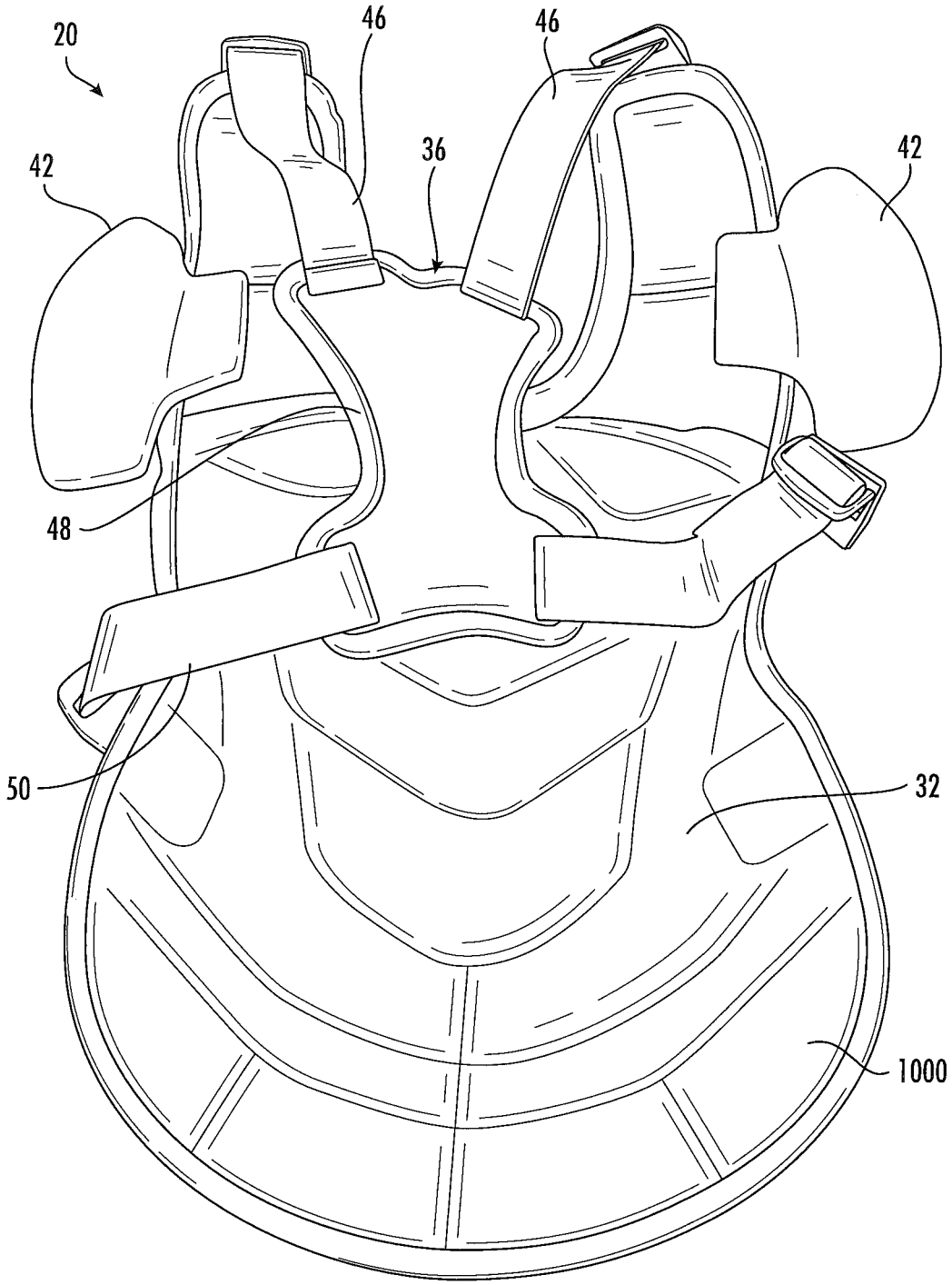
FIG. 2 is a rear perspective view of the example chest protector of FIG. 1.

FIGS. 1 and 2 are front and rear views, respectively, of an example chest protector 20. Chest protector 20 is configured to be worn across a front of a sport participant to protect the sport participant from collisions and projectile impacts. For purposes of this disclosure, the phrase "configured to" denotes an actual state of configuration that fundamentally ties the stated function/use to the physical characteristics of the feature proceeding the phrase "configured to". Chest protector 20 is selectively shapeable to conform to the particular shape and characteristics of the body of the sport participant. Chest protector 20 comprises shoulder portions 24, padded chest portion 28, padded torso portion 32, rear harness 36 and pliable shapers 40-1, 40-2 (collectively referred to as shapers 40).

Shoulder portions 24 comprise those portions of chest protector 20 that are configured to extend over the shoulders of a sport participant wearing the chest protector 20. In the example illustrated, shoulder portions 24 are padded. Shoulder portions 20 include a padding layer and/or multiple pads of resiliently compressible material that may be bent, twisted and deformed to facilitate freedom of movement for the sport participant, but also are resiliently compressible to absorb impacts. For example, in some implementations, the resiliently compressible material may comprise resiliently compressible foam. In some implementations, a hard outer panel or shell may be secured over the padding. As shown by the example of FIG. 1, chest protector 20 may additionally comprise shoulder extensions 42 which further extends over and protect the outer sides of the shoulders of the sport participant.

Padded chest portion 28 extends from shoulder portions 24 and is configured to cover a front of the chest of the sport participant wearing chest protector 20. Padded chest portion 28 comprises a layer and/or multiple pads of resiliently compressible material that may be bent, twisted and deformed to facilitate freedom of movement for the sport participant, but also are resiliently compressible to absorb impacts. For example, in some implementations, the resiliently compressible material may comprise resiliently compressible foam. In some implementations, a hard outer panel or shell may be secured over the padding.

Padded torso portion 32 extends from padded chest portion 28 and is configured to cover a front of the torso of the sport participant wearing the chest protector 20. Padded torso portion 32 comprises a layer and/or multiple pads of resiliently compressible material that may be bent, twisted and deformed to facilitate freedom of movement for the sport participant, but also are resiliently compressible to absorb impacts. For example, in some implementations, the resiliently compressible material may comprise resiliently compressible foam. In some implementations, a hard outer panel or shell may be secured over the padding.

As shown by FIGS. 1 and 2, the padding provided in each of shoulder portions 24, chest portion 28 and torso portion 32 is quilted. The padding is contained in little pockets separated by stitching. Such quilting provides multiple channels and seams between the individual pads, facilitating enhanced bending of such regions and enhanced freedom of movement for the sport participant. The size and shape of individual pads as well as the corresponding pattern of the quilting may vary depending upon the overall size and shape of chest protector 20 as well as a sport or other activity in which chest protector 20 is to be utilized. In some implementations, shoulder portions 24, chest portion 28 and/or torso portion 32 may omit such quilting.

Rear harness 36 (best shown in FIG. 2) extends from shoulder portions 24 and is configured to be connected to lower portions of chest protector 22. Rear harness 36 comprises back straps 46, back panel 48 and lower straps 50. Backstrap 46 extends from shoulder portions 24 to back panel 36. Back panel 36 extends across a center of the sport participant's back. In some implementations, back panel 36 may be padded. Lower straps 50 extend from opposite sides of back panel 36 and are connected to connection points 49 on opposite sides of chest protector 20. In the example illustrated, lower straps 50 are releasably connected to opposite sides of padded torso portion 32 and extend in a generally horizontal orientation across the back of the sport participant wearing chest protector 20. In the example illustrated, lower straps 50 are releasably connected by a quick release buckle at each of the connection points 49. In other implementations, lower strap 50 is releasably connected to the opposite sides of padded torso portion 32 at connection points 49 by other fastening mechanisms.

In some implementations, backstraps 46 and lower strap 50 may be formed by two individual straps which extend through back panel 36. The back panel 36 serves as a sleeve for guiding the direction and shape of the straps. In some implementations, straps 46 and/or lower strap 50 may be padded. In yet other implementations, backstraps 46 and lower strap 50 may have other configurations. For example, in some implementations, additional or fewer straps maybe divided and/or back panel 36 may be omitted. In other implementations, backstraps 46 may extend across the back of the sports participant without the use of a back panel.

Pliable shapers 40 (including 40-1 and 40-2) comprise elongate structures that are manually bendable to a selected shape or profile, wherein the pliable shaper retains the selected shape or profile once established until the pliable shaper is once again bent to a different shape or profile. Each of pliable shapers 40 is sufficiently pliable so as to be manually bendable or shapeable by sport participant without tools or equipment such that the pliable shaper 40 may be bent to a desired shape while the chest protector is worn, permitting the sport participant to more accurately match the selected shape of the chest protector to his or her body shape. Once in the desired shape, the pliable shaper 40 is sufficiently stiff so as to retain its selected shape once established despite the typical forces that may be exerted upon the pliable shaper 40 during movement of the sport participant wearing the chest protector 20 during a sport or activity.

Pliable shapers 40 facilitate shaping of the chest protector 20 to conform to the body shape of the sport participant wearing the chest protector 20. For example, each pliable shaper 20 may be bent to a shape that matches the shape of the sport participant wearing the chest protector 20. As a result, the chest protector 20 may better conform to the shape of the sport participant wearing the chest protector 20. The enhanced body-fitting shape may facilitate greater freedom of movement are better performance by the sport participant wearing the chest protector 20 is throwing diversity into a full concession. The enhanced body fitting shape may more actively locate and retain padding of the chest protector to better protect the sport participant wearing the chest protector. In some circumstances, a sport participant may wish that portions of the chest protector not conformally contact the body of the sport participant, but that such portions be spaced from the body of the sport participant. In such circumstances, the sport participant may shape the pliable shapers 40-1, 40-2 so as to provide such additional gaps or spacing between the chest protector and the underlying body of the sport participant.

Moreover, because the example pliable shapers 40 may be repeatedly reshaped, without damage to the pliable shapers, the example chest protectors may also be repeatedly reshaped. As a result, a single chest protector 20 may be easily reshaped to conform to the different body shapes of different sport participants wearing the same chest protector 20. The single chest protector 20 may adapt to differently sized sport participants. The example chest protector 20 may serve as a one chest protector fits all solution for reducing equipment costs and for ensuring that the chest protector 20 being worn by sport participants is properly sized and fitted to the sport participant's anatomy to best protect the upper body and torso of the sport participant.

In some implementations, each pliable shaper 40 may be formed of a material that is bendable at room temperature without any (non-force) stimulus being applied to the material and retains its selected shape at room temperature despite movement of the sport participant wearing the chest protector during a sport activity. For example, in some implementations, each pliable shaper 40 may be a metal band (having a polygonal cross-section, such as a rectangular or square cross-section) or a wire (such as an armature wire) that is bendable to a selected shape at room temperature and retains the selected shape despite movement of the sport participant wearing the chest protector during a sport activity or other activity. In some implementations, each pliable shaper 40 may be formed from other materials which are pliable or bendable at room temperature and which retain their selected shape despite movement of the sport participant wearing the chest protector during sport activity or other activity.

In some implementations, each of pliable shapers 40 may be shapeable upon the application of a stimulus, such as heat, to the pliable shaper, wherein withdrawal of the stimulus results in the pliable shaper retaining its shape until the stimulus is reapplied.

In some implementations, each of pliable shapers 40 is a single elongate integral homogenous structure across its length, such as in the case of an armature wire. In such implementations, each of the pliable shapers 40 may be bent at any of a continuum of different locations to provide shaper 40 with any shape. In such implementations, each of the pliable shapers 40 are equally bendable (and equally stiff) at each of the continuum of locations along the length of the pliable shaper. As a result, the pliable shaper 40 may accommodate bumps or other irregularities underlying the chest protector 20.

In some implementations, each of pliable shapers 40 may have different degrees of bendability and stiffness along its length. For example, a first portion of an individual pliable shaper may have a first of bendability and stiffness while a second different portion of the same individual pliable shaper 40 has a second different degree of bendability and stiffness. For example, a first portion of an individual pliable shaper 40 at room temperature may be more easily bendable as compared to a second different portion of the same individual pliable shaper at room temperature. As a result, different portions of the pliable shaper 40 may have different degrees of bendability and stiffness based upon the expected variations in the shape of the different portions based upon what portions of the sport participant anatomy the different portions wrap and/or based upon the expected amount of force that such portion will encounter during the sport activity, wherein the portions are not to substantially change shape in response to such forces.

Pliable shaper 40-1 is incorporated into padded torso portion 32 of chest protector 20 across the torso region of the chest protector 20. As a result, the chest protectors may be shaped to conform to the sport participant's torso for a slim fitting appearance and for enhanced freedom of motion. In the example illustrated, pliable shaper 40-1 extends below the connection points 49 for lower straps 50 of harness 36. As shown by FIG. 1, the pliable shaper 40-1 continuously extends, without interruption, from proximate a first side edge of the padded torso portion 32 to a second side edge of the padded torso portion 32, opposite the first side edge, across a transverse midpoint of the padded torso portion 32. As shown by FIGS. 1 and 2, strap 50 is configured to wrap about the torso of the sport participant wearing the chest protector, the strap 50 being connected to opposite transverse sides of the padded torso portion 32 at opposite side locations above the pliable shaper 40-1 and longitudinally between the padded chest portion 28 and the pliable shaper 40-1, the pliable shaper 40-1 transversely extending across the padded torso portion 32. As a result, the bottom edge 51 of chest protector 20 is less likely to curl up when being worn. In other implementations, pliable shaper 40-1 may extend above the connection points 49.

In the example illustrated, pliable shaper 40-1 extends from a first side edge 53 to a second opposite side edge 55 of the padded torso portion 32 of chest protector 20. As shown by FIG. 1, pliable shaper 40-1 comprises a continuous, uninterrupted unwound length extending from a first terminal end of the pliable shaper 40-1 that terminates proximate the first side edge to a second terminal end of the pliable shaper 40-1 that terminates proximate the second side edge. As further shown by FIG. 1, pliable shaper 40-1 is received within sleeve 1012 that has a first terminal end facing in a first sideways direction away from a centerline of the padded chest portion and a second terminal end facing in a second sideways direction away from the centerline of the padded chest portion. The first terminal of the pliable shaper 40-1 and the second terminal end of the pliable shaper 40-1 face away from one another. In some implementations, pliable shaper 40-1 may alternatively be formed by multiple distinct lengths secured to chest protector 20. For example, pliable shaper 40-1 may comprise a first length having opposite ends bonded, stitched bonded or otherwise secured to chest protector 20 and a second length having opposite ends stitched, bonded or otherwise secured to chest protector 20. In some implementations, pliable shaper 40-1 may comprise distinct lengths retained relative to chest protector 20 in associated individual sleeves or within a single continuous sleeve secured to chest protector 20.

In some implementations, pliable shaper 40-1 has a length of at least 10 inches. In one implementation pliable shaper 40-1 may comprise an aluminum pliable shaper having a diameter of at least 0.5 mm, and no greater than 10 mm. In other implementations, the pliable shapers 40 can have a circular cross-sectional area, a rectangular cross-sectional area, an irregularly shaped cross-sectional area, or variations in cross-sectional area along its length. In one implementation of pliable shaper 40-1 has a uniform bending stiffness along its entire length. The force required for a user to bend the pliable shaper with his or her hands can be within the range of 0.5 to 30 lbf. In one implementation, the force required to bend the pliable shaper can be within the range of 1 to 10 lbf. In other implementations, other values of force may be required to bend and shape the pliable shaper. As will be described hereafter, in some implementations, pliable shaper 40-1 may be provided with distinct regions along is length that are more bendable as compared to other regions along the length.

Pliable shapers 40-2 are incorporated in shoulder regions of the chest protector. As a result, the chest protectors may be shaped to conform to the shoulders of the sport participant for enhanced freedom of motion. Pliable shapers 40-2 may have similar stiffness characteristics as compared to pliable shaper 40-1 or may have different stiffness characteristics as compared to pliable shaper 40-1. For example, for enhanced freedom of motion, pliable shapers 40-2 may be more bendable and less stiff as compared to pliable shaper 40-1. In some implementation, pliable shapers 40-2 may be omitted.

In one implementation, chest protector 20 can include pliable shapers 40-1 in the torso portion 32 and a pair of pliable shapers 40-2 in the shoulder portions 24. In another implementation, the chest protector may be formed with pliable shaper 40-1 in the torso portion 32 and no pliable shapers 40-2. In another implementation, the chest protector 20 can be formed with pliable shapers 40-2 in the shoulder portions 24 and no pliable shaper 40-1.

Figure 3:
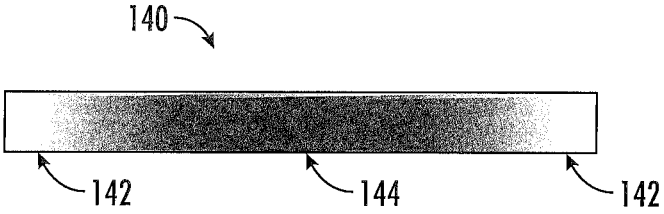
FIG. 3 is a sectional view of an example pliable shaper using the example chest protector of FIG. 1.

FIG. 3 is a sectional view of pliable shaper 140, one example implementation of pliable shaper 40-1 of chest protector 20. Pliable shaper 140 may likewise serve as pliable shapers 40-2 of chest protector 20. Pliable shaper 140 has different degrees of bendability or stiffness along different portions of its length. In the example illustrated, pliable chair 140 is provided with different degrees of bendability or stiffness by forming different portions from different materials or combinations of materials. In one implementation, the bendability/stiffness of pliable shaper 140 gradually changes along its length. In some implementations, those regions on the opposite ends of shaper 140 have the greatest degree of bendability (as compared to the central regions 144 of shaper 140) to facilitate a greater degree of bending or wrapping about the sides of the sport participant wearing chest protector 40. In some implementations, those regions 142 on the opposite ends of pliable shaper 140 have the greatest degree of stiffness as compared to central portions of shaper 140. In such implementation's, a greater degree of manual force may be required to initially bend the opposite ends of shaper 140; however, once bent to the desired form fitting shape, the operative ends may better retain their shape despite experiencing larger forces when worn by sport participant during a sport or activity.

In one implementation, the different degree of bendability along the length of pliable shaper 140 is provided by forming the different regions of bendability 40 from different material compositions or different materials. In one implementation, the different degree of bendability along the length of pliable shaper 140 is provided by differently treating (such as with heat) the material which is homogenous along the length of shaper 140, wherein the material how once cooled, exhibits different bendability material properties based upon the prior heat treatment.

Figure 4:
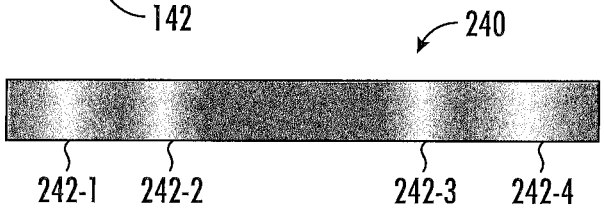
FIG. 4 is a sectional view of an example pliable shaper using the example chest protector of FIG. 1.

FIG. 4 is a sectional view of pliable shaper 240, one implementation of pliable shaper 40-1 of chest protector 20. Pliable shaper 240 may likewise serve as pliable shapers 40-2 of chest protector 20. In contrast to pliable shaper 140 in which the opposite ends 142 have a different degree of bendability/stiffness as compared to a central region 144, pliable shaper 240 has multiple distinct regions 242-1, 242-2, 242-3 and 242-4 (collectively referred to as regions 242) along its length, between the opposite ends, that have a greater bendability as compared to the remaining regions of shaper 240 (those darker regions). Such regions 242 are located at locations along the length of shaper 240 where it may be beneficial to provide such enhanced bending to match the body of the sport participant wearing chest protector 20. In the example illustrated, the degree of bendability gradually increases in directions extending away from the particular region 242. As described above with respect to shaper 140, the different regions with different bendability may be provided by forming such different regions 242 with different materials or material compositions by differently treating the same material at each of the regions 242. In some implementations, shaper 240 may be provided with a first oval or rounded shape or profile along its length, wherein the general oval shape is maintained, but wherein find adjustments to the profile of shaper 240 along the length may be achieved by manually bending shaper 240 at one or more regions 242.

Figure 5:
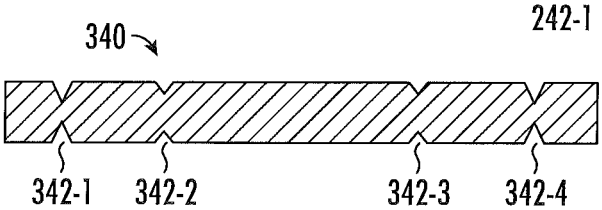
FIG. 5 is a sectional view of an example pliable shaper using the example chest protector of FIG. 1.

FIG. 5 is a sectional view of pliable shaper 340, one implementation of pliable shaper 40-1 of chest protector 20. Pliable shaper 340 may likewise serve as pliable shapers 40-2 of chest protector 20. Similar to pliable shapers 140 and 240, pliable shaper 340 has varying degrees of bendability along its length at room temperature. In the example illustrated, pliable shaper 340 is formed from my homogenous material along its entire length, wherein the different reason bendability are provided by varying the dimensions, diameter or thickness, along its length. In the example illustrated, regions 342-1, 342-2, 342-3 and 342-4 each have a reduced diameter or thickness as compared to the remaining portions so as to have a higher degree of bendability. In some implementations, amongst regions 342, the diameters may vary to further customize the degree of bendability at different regions along the length of shaper 340. In some implementations, shaper 340 may be provided with a first oval or rounded shape or profile along its length (not the cross-sectional shape, but the shape of the length of the shaper when wrapped about a sport participant), wherein the general oval shape is maintained, but wherein find adjustments to the profile of shaper 440 along the length may be achieved by manually bending shaper 440 at one or more regions 442.

Figure 6:
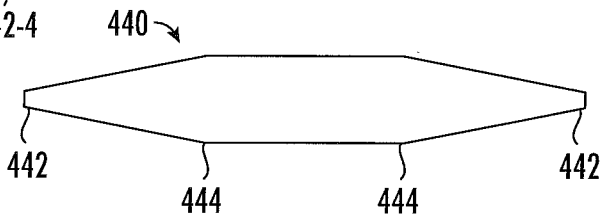
FIG. 6 is a sectional view of an example pliable shaper using the example chest protector of FIG. 1.

FIG. 6 is a sectional view of pliable shaper 440, one implementation of pliable shaper 40-1 of chest protector 20. Pliable shaper 440 may likewise serve as pliable shapers 40-2 of chest protector 20. Similar to pliable shaper 340, pliable shaper 440 had different regions with different degrees of bendability along its length by varying the dimensioning of pliable shaper 440 along its length. In the example shown in FIG. 6, the degree of bendability gradually increases from the opposite outer ends 442 to midpoints 444. Regions between midpoints 444 have a substantially uniform bendability. In some implementations, shaper 440 may be provided with a first oval or rounded shape or profile along its length, wherein the general oval shape is maintained, but wherein find adjustments to the profile of shaper 440 along the length may be achieved by manually bending shaper 440 proximate to ends 442.

Figure 7:
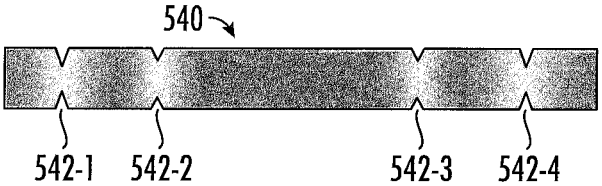
FIG. 7 is a sectional view of an example pliable shaper using the example chest protector of FIG. 1.

FIG. 7 is a sectional view of pliable shaper 540, one implementation of pliable shaper 40-1 of chest protector 20. Pliable shaper 540 may likewise serve as pliable shapers 40-2 of chest protector 20. Pliable shaper 540 has a varying bendability along its length which is provided by both varying the material composition of shaper 540 along its length and varying the thickness or diameter of shaper 540 along its length. In the example illustrated, pliable shaper 540 has intermediate regions 542-1, 542-2, 542-3 and 542-4 (collectively referred to as regions 542) that are both formed from a material having a greater degree of bendability and having a reduced diameter or thickness to provide a greater degree of bendability. In some implementations, the degree of bendability at each of regions 542 is such that shaper 540 may be manually bent (without tools) at each of such regions to a desired sport participant body conforming shape while chest protector 20 is worn by the sport participant and such that the established shape will be retained when the sport participant is wearing the chest protector 20 and participating in the sport or other activity. In some implementations, those regions of shaper 540, other than regions 542, have a much greater degree of stiffness thus do not be manually bendable or us to minimally bendable. In some implementations, shaper 540 may be provided with a first oval or rounded shape or profile along its length, wherein the general oval shape is maintained, but wherein find adjustments to the profile of shaper 540 along the length may be achieved by manually bending shaper 540 at one or more regions 542.

Figure 8:
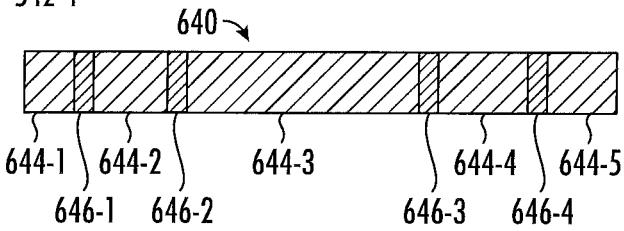
FIG. 8 is a sectional view of an example pliable shaper using the example chest protector of FIG. 1.

FIG. 8 is a sectional view of pliable shaper 640, one implementation of pliable shaper 40-1 of chest protector 20. Pliable shaper 640 may likewise serve as pliable shapers 40-2 of chest protector 20. Shaper 640 offers a varying degree of bendability along its length to facilitate bending in predetermined locations along its length. In the example illustrated, shaper 640 comprises a series of segments 644-1, 644-2, 644-3, 644-4 and 644-5 (collectively referred to as segment 644) pivotally connected to one another by pivot joints 646-1, 646-2, 646-3 and 646-4 (collectively referred to as pivot joints 646), respectively. Segments 644 have a lower degree of bendability as compared to pivot joints 646. In some implementations, segment 644 are not bendable, but may be provided with a predefined arcuate profile are shape generally corresponding to the body profile of the sport participant across which such segments will extend, wherein find just may made by pivoting such segments 644 relative to one another about pivot joints 646.

Pivot joints 646 have a sufficiently low resistance to relative pivoting such that each joints 646 facilitate pivoting of one consecutive segment 644 relative to an adjacent consecutive segment 644, but provide sufficient resistance to such relative pivoting to inhibit inadvertent or accidental pivoting when encountering those forces that are expected while the chest protector 20 is being worn during a sport or other activity. In some implementations, pivot joint 646 are each formed from by a living hinge, a hinge of flexible or bendable material, such as a rubber or rubber-like material. In some implementations, pivot joint 646 comprise mechanical hinges. In the example illustrated, each of pivot joints 646 have an equal degree of resistance to pivoting.

Figure 9:
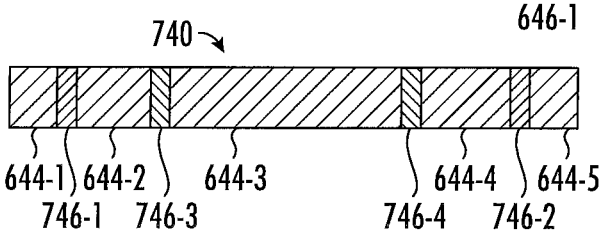
FIG. 9 is a sectional view of an example pliable shaper using the example chest protector of FIG. 1.

FIG. 9 is a sectional view of pliable shaper 740, one implementation of pliable shaper 40-1 of chest protector 20. Pliable shaper 740 may likewise serve as pliable shapers 40-2 of chest protector 20. Pliable shaper 740 is similar to pliable shaper 640 except that shaper 740 comprises pivot joints 746-1, 746-2 which may be more easily pivoted or more easily pivoted to a greater extent as compared to pivot joints 746-3 and 746-4. Said another way, pivot joints 746-1 and 746-2 offer less resistance to relative the pivoting of the adjacent segments 644 as compared to pivot joints 746-3 and 746-4. As a result, segment 644-1 and 644-5 may be manually bent to more acute angles to wraparound the sport participant or to accommodate varying body shapes of the sport participant as compared to region 644-2 and 644-4.

Figure 10:
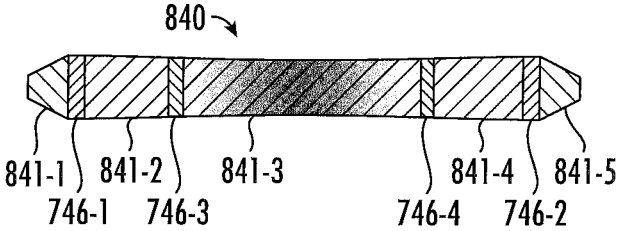
FIG. 10 is a sectional view of an example pliable shaper using the example chest protector of FIG. 1.

FIG. 10 is a sectional view of pliable shaper 840, one implementation of pliable shaper 40-1 of chest protector 20. Pliable shaper 840 may likewise serve as pliable shapers 40-2 of chest protector 20. Pliable shaper 840 provides different degrees of bendability along its length by employing different materials with different material compositions, by providing different regions or portions with different dimensions (thickness or diameter) and by pivotably connecting different segments with different pivot joints that offer different degrees of resistance to pivotal movement. In the example illustrated, segments 841-1 and 841-5 have varying dimensions along their individual lengths. Segment 841-3 has a varying material composition along flank to gradually change the bendability along its length. Pivot joints 746-1 and 746-5 have a lower degree of resistance to pivoting as compared to pivot joints 746-3 and 746-4.

In some implementations, pliable shapers 40-2 have the same construction as pliable shaper 40-1. In some implementations, pliable shapers 40-2 may have a different construction as compared to pliable shaper 40-1. For example, pliable shaper 40-1 may comprise one of pliable shapers 140, 240, 340, 440, 540, 640, 740 or 840 as described above while pliable shapers 40-2 may comprise a different one of pliable shapers 140, 240, 340, 440, 540, 640, 740 or 840. In some implementations, shapers 40-1 and 40-2 may have the same bendability in the same bendability profile. In other implementations, shapers 40-140-2 may have different bendabilities/stiffnesses are different bendability profiles (the way that the bendability changes along the length of the shaper) as compared to one another.

Figure 11:
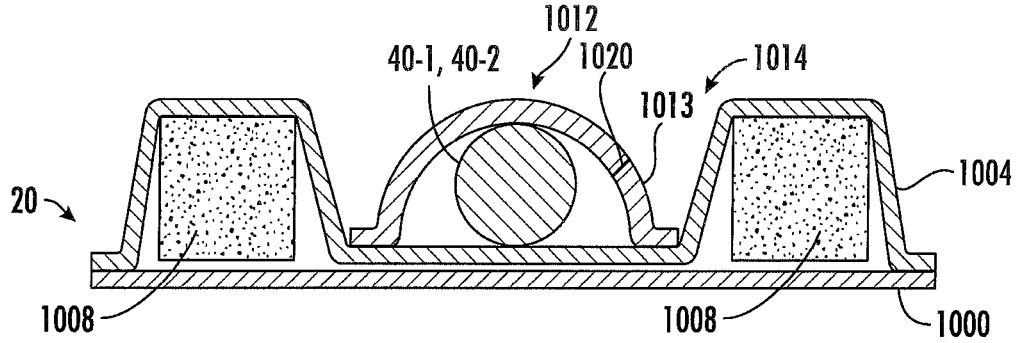
FIG. 11 is a sectional view of an example implementation of the chest protector of FIG. 1 taken along line 11-11.

FIG. 11 is a sectional view of pliable shaper 40-1 taken along line 11-11. FIG. 11 may likewise be a sectional view of one of pliable shapers 40-2 taken along line 11-11 of FIG. 1. FIG. 11 illustrates one example of how pliable shapers 40 may be retained relative to chest protector 20.

As shown by FIG. 11, chest protector 20 comprises back panel 1000, front panel 1004, resiliently compressible pads 1008 and sleeve 1012. Panel 1000 is joined to panel 1004 with pads 1008 captured therebetween. In one implementation, panels 1000 and 1004 are joined by stitching. In other implementations, panels 1000, 1004 are joined by adhesives, a fusing of materials, staples, fasteners and the like.

Figure 12:
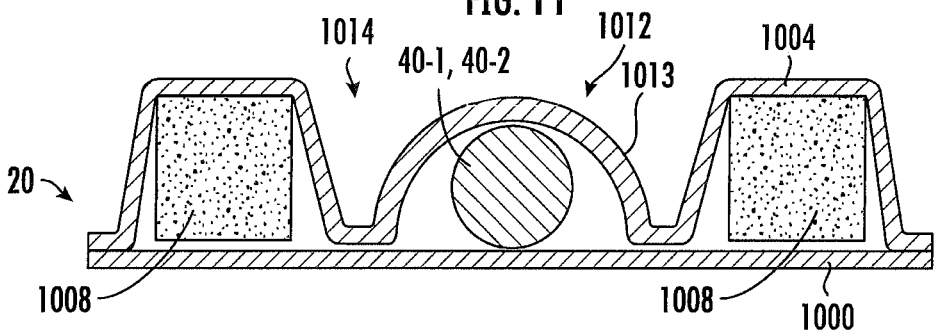
FIG. 12 is a sectional view of an example implementation of the chest protector of FIG. 1 taken along line 11-11.

Sleeve 1012 is formed by panel 1013 integrally joined to panel 1004, such that panel 1013 is a central region of panel 1004, so as to capture pliable shaper 40-1, 40-2 between panel 1013 and panel 1000. As shown by FIG. 12 (taken along line 11-11 of FIG. 1), in other implementations, sleeve 1012 may be formed by panel 1004 such as where panel 1004 comprises a single panel that extends over both of pads 1008 and pliable shaper 40-1, 40-2 and where panel 1004 is joined to panel 1000 at locations between pads 1008 and sleeve 1012. As further shown may FIG. 11, padded region torso portion comprises a first pad 1008 and a second pad 1008 distinct and separate from the first pad 1008 and wherein the sleeve 1012 extends between the first pad 1008 and the second pad 1008. In the implementation shown in FIG. 12, sleeve 1012 captures the pliable shaper 40-1, 40-2 between sleeve 1012 and panel 1000.

As further shown by FIGS. 11 and 12, pliable shaper 40-1, 40-2 is recessed between pads 1008, recessed from the front surface of chest protector 20. As a result, shaper 40-1, 40-2 is positioned more closely to back panel 1004 shaping and retaining the shape of back panel 1000 which may extend adjacent to the body of the sport participant wearing chest protector 20. In the example illustrated, shaper 40-1, 40-2 and its overlying sleeve 1012 are both recessed within a channel or groove 1014 formed between pads 1008.

As shown by FIG. 1, sleeve 1012 extends along substantially the entire length of pliable shaper 40-1 as well as pliable shapers 40-2. As a result, pliable shapers 40-140-2 are concealed and protected. In other implementations, sleeve 1012 may comprise a single loop or multiple loops that extends over pliable shapers 40-1, 40-2, but which are spaced from one another along the length of pliable shaper 40-1, 40-2. In such implementations, portions of pliable shapers 40-1, 40-2 may be exposed.

In some implementations, pliable shapers 40-1, 40-2 are loosely are freely retained within sleeves 1012. In some implementations, each of sleeves 1012 may comprise an elongate pocket having an elongate slit or opening 1020 along its length into which the pliable shaper 40-1, 40-2 may be dropped or inserted, wherein the pocket 1020 may be selectively closable by means of a hook and loop fastener, a zipper or the like extending in at least selected portions along the length of sleeve 1012. In some implementations, each of sleeves 1012 may include an end opening 1022 through which pliable shaper 40-1, 40-2 may be inserted or threaded into sleeve 1012. The end opening 122 may be selectively close or sealed by a hook and loop fastener, a zipper, a button, a snap or other closing mechanism. In such implementations, a sport participant may customize the degree of stiffness or its bendability profile by interchanging one pliable shaper 40-1, 40-2 in chest protector 20 with a different pliable shaper 40-1, 40-2 having a different stiffness or bendability profile.

In some implementations, the pliable shaper 40-1, 40-2 may be stitched or otherwise fixedly contained within its respective sleeve 1012. In some implementations, the pliable shaper 40-1, 40-2 may be directly secured to panel 1004 (where sleeve 1012 is secured to panel 1004) or may be directly secured to panel 1000 (where panel 1004 forms sleeve 1012 and does not extend between shaper 40-40-2 and panel 1000), by stitching, glue or the like.

Figure 13:
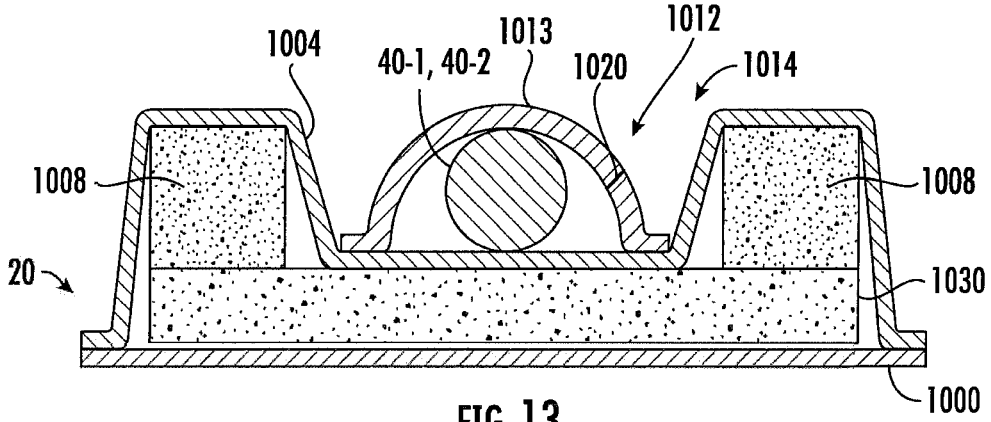
FIG. 13 is a sectional view of an example implementation of the chest protector of FIG. 1 taken along line 11-11.

FIG. 13 is a sectional view of pliable shaper 40-1 taken along line 11-11. FIG. 13 may likewise be a sectional view of one of pliable shapers 40-2 taken along line 11-11 of FIG. 1. FIG. 13 illustrates one example of how pliable shapers 40 may be retained relative to chest protector 20. The example shown in FIG. 13 is similar to the example shown in FIG. 11 except that chest protector 20 additionally comprises a resiliently compressible pad 1030.

Resiliently compressible pad 1030 underlies pliable shaper 40-1, 40-2, extending between pliable shaper 40-140-2 and back panel 1000. In the example illustrated, pad 1030 is sandwiched between panel 1000 and panel 1004. In some implementations, such as implementation shown in FIG. 12, pad 1030 may be sandwiched between back panel 1000 and a bottom surface of pliable shaper 40-1, 40-2. Pad 1035 additional cushioning opposite the channel 1014. In the example illustrated, pad 1030, although resiliently flexible, is configured so as to be held and retained in shape in accordance with the established shape of pliable shaper 40-1, 40-2.

Figure 14:
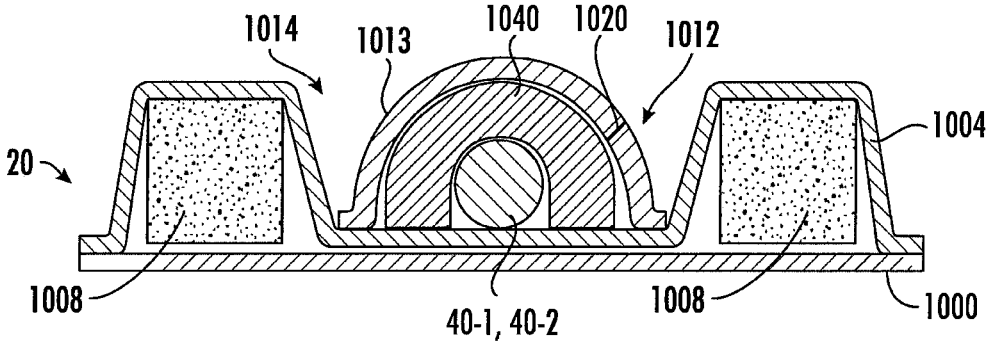
FIG. 14 is a sectional view of an example implementation of the chest protector of FIG. 1 taken along line 11-11.

FIG. 14 is a sectional view of pliable shaper 40-1 taken along line 11-11. FIG. 14 may likewise be a sectional view of one of pliable shapers 40-2 taken along line 11-11 of FIG. 1. FIG. 14 illustrates one example of how pliable shapers 40 may be retained relative to chest protector 20. The example shown in FIG. 14 is similar to the example shown in FIG. 11 except that chest protector 20 additionally comprises a resiliently compressible pad 1040. Pad 1040 wraps partially about pliable shaper 40-1, 40-2 and is sandwiched between sheath 1012 and layer 1004. Pad 1040 provides additional cushioning within channel 1014 about shaper 40-1, 40-2. Although pad 1040 is resiliently compressible and bendable, pad 1040 form from material and is dimensioned such that it assumes the general path or shape of shaper 40-1, 40-2 and is retained in such a shape while a sport participant is wearing chest protector 40 during a sport or activity. It should be appreciated that in some implementations, pad 1040 may also be employed in the examples shown in FIGS. 12 and 13 where pad 1040 would partially wrap around shaper 40-1, 40-2 within the interior of sleeve 1012.

Figure 15:
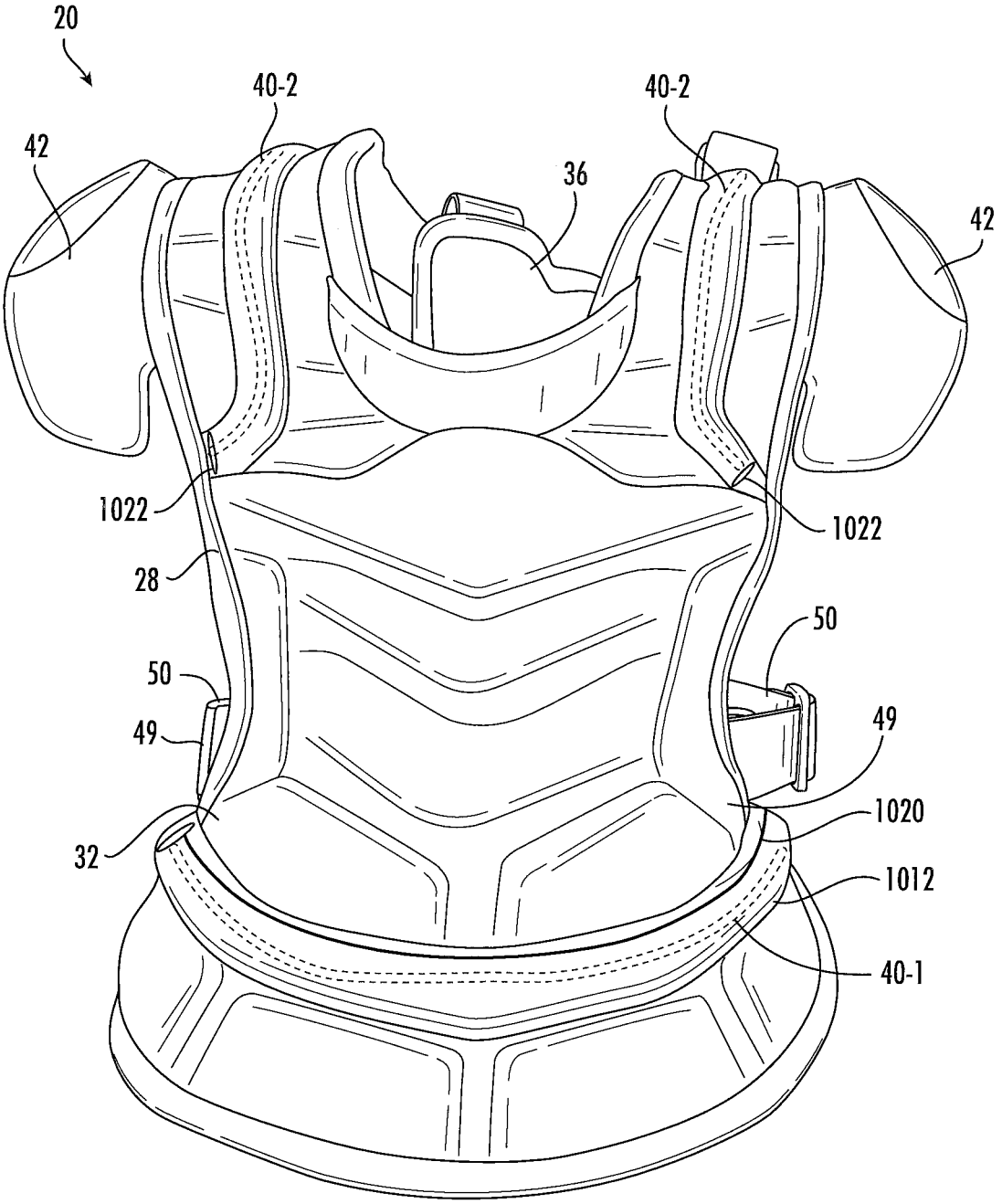
FIG. 15 is a front perspective view of the example chest protector of FIG. 1 with the example pliable shaper conforming the chest protector to a selected shape.
Figure 16A:
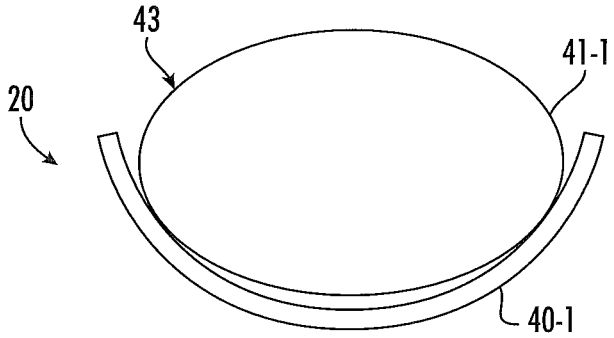
FIG. 16A is a sectional view schematically illustrating an example pliable shaper of the chest protector of FIG. 1 shaped to conform to a first torso of a sport participant wearing the chest protector.
Figure 16B:
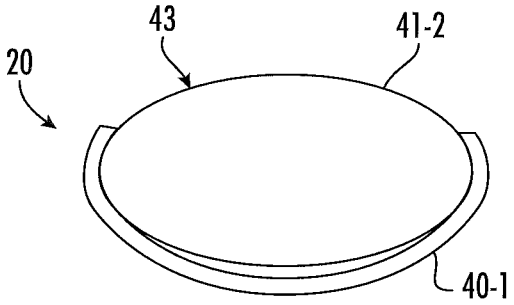
FIG. 16B is a sectional view schematically illustrating an example pliable shaper of the chest protector of FIG. 1 shaped to conform to a second differently sized/shaped torso of a sport participant wearing the chest protector.

FIG. 15 is a front view of chest protector 20 with pliable shapers 40-1, 40-2 shaped by the sport participant to form fit the sport participant. FIGS. 16A and 16B are sectional views schematically illustrating shaper 40-1 being differently shaped to conform to differently shaped torsos 41-1 and 41-2

(collectively referred to as torsos 41) of different sport participants 43. FIGS. 16A and 16B illustrate an example pliable shaper 40-1 which may be bent to a continuous smooth arc along its entire length. As shown by FIG. 16B, pliable shaper 40-1 may be bent and deformed stalls to better wrap around torso 41-2 was a differently shaped and smaller than torso 41-1. At same time, pliable shaper 40-1 may be differently bent or shaped to conform to the wider torso 41-1.

Figure 17A:
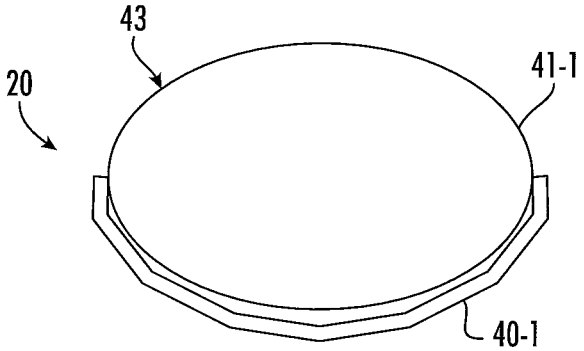
FIG. 17A is a sectional view schematically illustrating an example pliable shaper of the chest protector of FIG. 1 shaped to conform to a first torso of a sport participant wearing the chest protector.
Figure 17B:
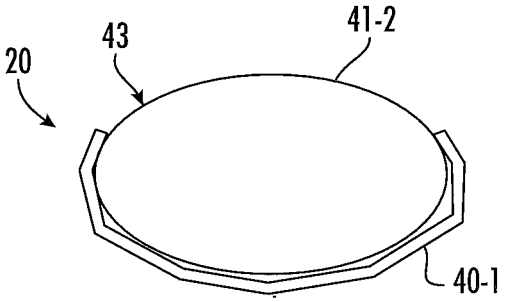
FIG. 17B is a sectional view schematically illustrating an example pliable shaper of the chest protector of FIG. 1 shaped to conform to a second differently sized/shaped torso of a sport participant wearing the chest protector.

FIGS. 17A and 17B are sectional views schematically illustrating shaper 40-1 being differently shaped to conform to differently shaped torsos 41 of different sport participants 43. FIGS. 17A and 17B illustrate an example pliable shaper 40-1 which may be bent at distinct predefined regions along its entire length. For example, pliable shaper 40-1 may comprise any of pliable shapers to 40, 340, 540, 640, 740 and 840 described above. In such implementations, the multiple more easily bendability regions bend or pivot such that the overall length of shaper 40-1 has a shape that better matches the shape of the torso of the sport participant wearing chest protector 20.

Figure 18:
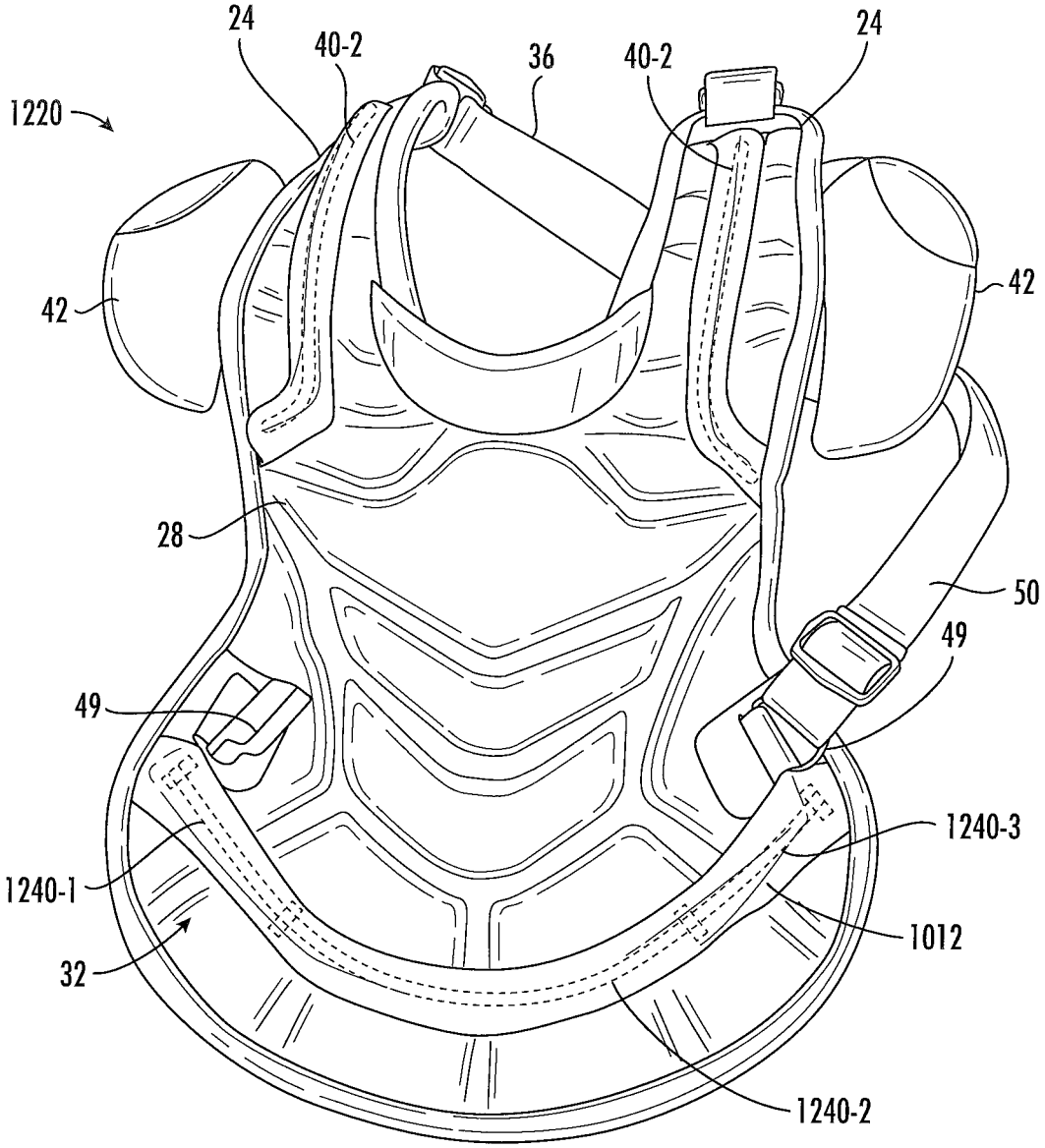
FIG. 18 is a front perspective view of an example chest protector.
Figure 19:
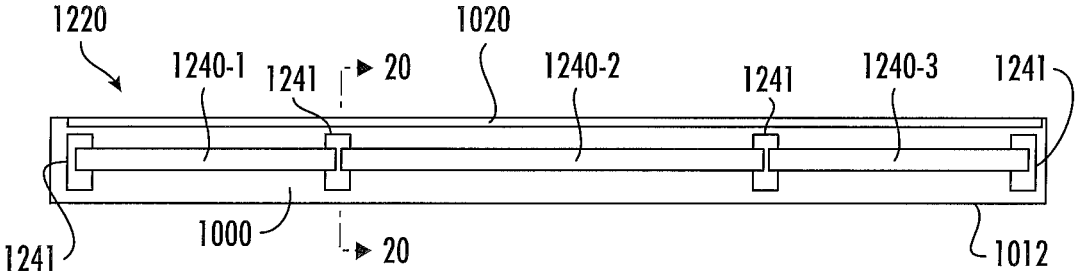
FIG. 19 is a front view illustrating example pliable shapers of the chest protector of FIG. 18.
Figure 20:
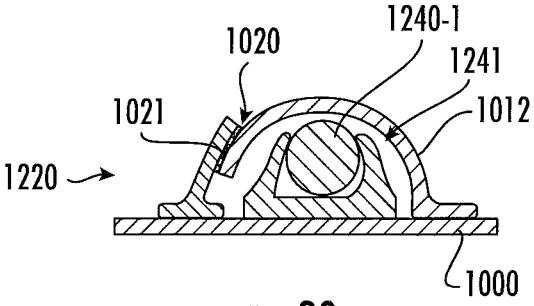
FIG. 20 is a sectional view of the chest protector of FIG. 19 taken along line 20-20.

FIGS. 18-20 illustrate portions of an example chest protector 1220. Chest protector 1220 is similar to chest protector 20 described above except that chest protector 1220 comprises pliable shapers 1240-1, 1240-2, 1240-3 (collectively referred to as pliable shapers 1240) and retainers 1241. Those remaining portions of just protector 1220 which correspond to portions of chest protector 20 are numbered similarly.

Pliable shapers 1240 comprise individual pliable shapers secured to chest protector 1220, independent of one another, in series across padded torso portion 32 of chest protector 1220. Each of pliable shapers 1240 has opposite ends secured or retained with respect to chest protector 1220 such that bending or reshaping of an individual pliable shaper 1240 results in those portions of chest protector 1220 between the opposite ends being retained in a shape corresponding to the shape of the individual pliable shaper 1240. Each of individual shapers 1240 may be differently bent or shaped to provide a customized shape or fit to the body shape of the sport participant wearing chest protector 1220.

In some implementations, each of pliable shapers 1240 has the same stiffness in the same stiffness profile along its length. In other implementations, at least some of pliable shapers 1240 may have different stiffnesses are different bendability/stiffness profiles along their lengths. In some implementations, pliable shapers 1240 may comprise any of pliable shapers 140, 240, 340, 440, 540, 640, 740 or 840, described above. A single sleeve 1240 may contain different kinds or types of pliable shapers. In some implementations, each of pliable shapers 1240 may comprise a bendable aluminum armature wire. In some implementations, each of pliable shapers 1240 may comprise the pliable shaper 40-1 described above.

Similar to pliable shaper 40-1, pliable shapers 1240 are contained within an elongate sleeve 1012. In the example illustrated, sleeve 1012 comprises an elongate pocket opening 1020, facilitating removal and the exchange of different pliable shapers 1240 within the interior of sleeve 1012. Opening 1020 may be retained in a closed position through the means of a hook and loop fastener arrangement 1021. As described above, in other implementations, sleeve 1012 may be sealed or closed or may include other openings for the insertion and removal of pliable shapers 1240.

Retainers 1241 retained and secure pliable shapers 1240 in place relative to remaining portions of chest protector 1220. FIG. 20 illustrates an example retainer 1241. In the example illustrated, retainer 1241 comprises a resiliently flexible polymeric C-shaped grip secured to panel 1000 within sleeve 1012. Retainer 1241 releasably grips and retains retainer 1241 in place. As a result, existing pliable shapers 1240 may be removed from sleeve 1012 and replaced with different pliable shapers 1240 depending upon the desired degree of bendability/stiffness.

In other implementations, retainers 1241 may comprise other maxims for securing pliable shapers 1240 in place. For example, pliable shapers 1240 may be removably secured in place by loops, latches or other mechanisms. In some implementations, pliable shapers 1240 may be fixedly secured in place by adhesives, stitching and the like. Although pliable shapers 1240 are illustrated as being secured in series, in other implementations, pliable shapers 1240 may be secured in a staggered arrangement. In some implementations, multiple pliable shapers may at least partially overlap one another in directions across padded torso portion 32. With such an overlapping arrangement, particular portions may be made more robust against an inadvertent change in shape during the course of participation by the sport participant in the sporting activity.

Although the present disclosure has been described with reference to example implementations, workers skilled in the art will recognize that changes may be made in form and detail without departing from disclosure. For example, although different example implementations may have been described as including features providing various benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A chest protector comprising:

shoulder portions configured to extend over shoulders of a sport participant wearing the chest protector;

a padded chest portion configured to extend over the chest of the sport participant wearing the chest protector;

and a padded torso portion configured to extend over a torso of the sport participant wearing the chest protector;

and a pliable shaper extending across the padded torso portion, the pliable shaper being manually bendable and configured such that once in a selected shape, is sufficiently stiff so as to retain the selected shape;

a resiliently compressible layer covering the pliable shaper;

a sleeve receiving the pliable shaper and the resiliently compressible layer, wherein the shoulder portions extend rearward from the padded chest portion, wherein the padded torso portion comprises a padded region having an outer forward-facing surface having a channel projecting rearward from the forward-facing surface and wherein the pliable shaper is recessed from the outer forward-facing surface within the channel, and wherein the padded region comprises a first pad and a second pad distinct and separate from the first pad and wherein the sleeve extends between the first pad and the second pad.

2. The chest protector of claim 1 further comprising a sleeve receiving the pliable shaper, the sleeve having a first terminal end facing in a first sideways direction away from a centerline of the padded chest portion and a second terminal end facing in a second sideways direction away from the centerline of the padded chest portion, wherein the pliable shaper has a first terminal end terminating proximate the first terminal end of the sleeve and a second terminal end terminating proximate the second terminal end of the sleeve and wherein the first terminal end of the pliable shaper and the second terminal end of the pliable shaper face away from one another.

3. The chest protector of claim 1, wherein the chest protector further comprises a strap configured to wrap about a torso of a sport participant wearing the chest protector, the strap connected to the second pad, wherein the pliable shaper extends between the second pad and the shoulder portions.

4. The chest protector of claim 1, wherein each of the shoulder portions contains a second pliable shaper, the second pliable shaper being manually bendable and configured such that once in a selected shape, is sufficiently stiff so as to retain the selected shape.

5. The chest protector of claim 1, wherein the pliable shaper has a varying dimension along its length.

6. The chest protector of claim 1 further comprising:

a second pliable shaper extending across the padded torso portion.

7. The chest protector of claim 1, wherein the pliable shaper has a varying degree of stiffness along its length.

8. The chest protector of claim 1 further comprising:

a sleeve having an interior removably receiving the pliable shaper; and an opening in communication with the interior of the sleeve to facilitate withdrawal of the pliable shaper from the interior of the sleeve.

9. The chest protector of claim 1, wherein the pliable shaper has a length of at least 10 inches.

10. The chest protector of claim 1, wherein the pliable shaper is an aluminum pliable shaper having a diameter of at least 0.5 mm and no greater than 10 mm.

11. The chest protector of claim 1, wherein the pliable shaper comprises an armature wire.

12. The chest protector of claim 1 wherein the padded torso portion has a first side edge and a second opposite side edge, wherein the pliable shaper comprises a continuous, uninterrupted length extending from a first terminal end of the pliable shaper that terminates proximate the first side edge to a second terminal end of the pliable shaper that terminates proximate the second side edge.

13. The chest protector of claim 1 further comprising a strap configured to wrap about the torso of the sport participant wearing the chest protector, the strap being connected to opposite transverse sides of the padded torso portion at opposite side locations above the pliable shaper and longitudinally between the padded chest portion and the pliable shaper, the pliable shaper transversely extending across the padded torso portion.

14. The chest protector of claim 13, wherein the pliable shaper continuously extends, without interruption, from proximate a first side edge of the padded torso portion to a second side edge of the padded torso portion, opposite the first side edge, across a transverse midpoint of the padded torso portion.

15. A chest protector comprising:

shoulder portions configured to extend over shoulders of a sport participant wearing the chest protector;

a padded chest portion configured to extend over the chest of the sport participant wearing the chest protector; and a padded torso portion configured to extend over a torso of the sport participant wearing the chest protector;

a pliable shaper extending across the padded torso portion, the pliable shaper being manually bendable and configured such that once in a selected shape, is sufficiently stiff so as to retain the selected shape; and a strap configured to wrap about the torso of the sport participant wearing the chest protector, the strap being connected to opposite transverse sides of the padded torso portion at opposite side locations above the pliable shaper and longitudinally between the padded chest portion and the pliable shaper, the pliable shaper transversely extending across the padded torso portion, wherein the shoulder portions extend rearward from the padded chest portion, wherein the padded torso portion comprises a padded region having an outer forward-facing surface having a channel projecting rearward from the forward-facing surface and wherein the pliable shaper is recessed from the outer forward-facing surface within the channel, and wherein the pliable shaper continuously extends, without interruption, from proximate a first side edge of the padded torso portion to a second side edge of the padded torso portion, opposite the first side edge, across a transverse midpoint of the padded torso portion.

* * * * *